US011577880B2

(12) United States Patent
Meuti

(10) Patent No.: US 11,577,880 B2
(45) Date of Patent: Feb. 14, 2023

(54) PROTECTIVE ELEMENT FOR BOTTLES AND RELATED BLANK

(71) Applicant: RedBox S.r.l., Pomezia (IT)

(72) Inventor: Diego Meuti, Pomezia (IT)

(73) Assignee: RedBox S.r.l., Pomezia (IT)

( * ) Notice: Subject to any disclaimer, the term of this patent is extended or adjusted under 35 U.S.C. 154(b) by 0 days.

(21) Appl. No.: 17/480,186

(22) Filed: Sep. 21, 2021

(65) Prior Publication Data

US 2022/0089312 A1 Mar. 24, 2022

(30) Foreign Application Priority Data

Sep. 21, 2020 (IT) ..... 102020000022165

(51) Int. Cl.
*B65D 5/50* (2006.01)

(52) U.S. Cl.
CPC ..... *B65D 5/5038* (2013.01)

(58) Field of Classification Search
CPC ..... B65D 5/50; B65D 5/5038; B65D 5/504; B65D 81/05

(Continued)

(56) References Cited

U.S. PATENT DOCUMENTS 2,426,899 A 9/1947 Pantalone
4,341,308 A * 7/1982 Pasquini ..... B65D 5/5042 206/433

FOREIGN PATENT DOCUMENTS

DE 8910314 12/1989
EP 2292517 A1 * 3/2011 ..... B65D 5/504

(Continued)

OTHER PUBLICATIONS

Rapporto di Ricerca e Opinione Scritta [Search Report and Written Opinion] dated May 14, 2021 From the Ministero dello Sviluppo Economico, Direzione Generale Sviluppo Produttivo e Competitivita, Uffico Italiano Brevetti e Marchi Re. Application No. IT202000022165. 8 Pages).

*Primary Examiner* — Bryon P Gehman

(57) ABSTRACT

The present invention relates to a protection element (1) in papercraft material for protecting one or more objects (B), in particular for protecting one or more bottles (B), comprising two support elements (2, 3) connected by a connection element (4), wherein each support element (2, 3) has an upper wall (5; 6) and two support walls (7, 8; 9, 11) associated with the respective upper wall (5; 6) to support it. A first support wall (8; 9) of each support element (2, 3) is arranged at said connection element (4) and has a shaped opening (16; 17) for each object (B) to be protected. Furthermore, said connection element (4) has two shaped flaps (18; 19) for each object (B) to be protected, each shaped flap (18; 19) being arranged at the respective support element (2; 3) and projecting on the respective upper wall (5, 6) of the respective support element (2; 3) and on a respective shaped opening (16; 17) of the respective first support wall (8; 9), each shaped flap (18; 19) being arranged so that when the respective object (B) to be protected is arranged on said protection element (1) resting on the respective shaped flaps (18; 19), the weight of said object (B) acts on the respective shaped flaps (18; 19) to insert in the respective shaped openings (16; 17) of said support walls (8; 9) and lock the object (B) in position. Furthermore, the present invention relates to a blank (10) for obtaining the protection element (1) according to the invention.

14 Claims, 7 Drawing Sheets

(58) Field of Classification Search
USPC ..... 206/433, 485, 486, 526, 764–766
See application file for complete search history.

(56) References Cited

FOREIGN PATENT DOCUMENTS

| | | | | |
|---|---|---|---|---|
| FR | 2903966 | A1 * | 1/2008 | ..... B65D 5/5083 |
| IT | 0001384271 | | 12/2007 | |
| WO | WO 2015/049702 | | 4/2015 | |

* cited by examiner

PROTECTIVE ELEMENT FOR BOTTLES AND RELATED BLANK

RELATED APPLICATIONS

This application claims the benefit of priority of Italian Patent Application No. 102020000022165 filed on Sep. 21, 2020, the contents of which are incorporated by reference as if fully set forth herein in their entirety.

FIELD AND BACKGROUND OF THE INVENTION

The present invention relates to a protection element for bottles and the relative blank.

More precisely, the present invention relates to an element capable of housing at least one bottle and of being inserted in a box for the transport and protection of the bottle housed therein.

The scope of the present invention specifically relates to the protection and transport of glass bottles, however, the protection element according to the invention can also be used to protect and transport other fragile or other type objects.

At the state of the art, protection elements are known for bottles, obtained from sheets of papercraft material which wrap the upper and lower portions of the bottles to protect them once they have been inserted inside a container or box for the transport thereof. An example of such a solution is described in international patent application no. WO 2015/049702 A1.

However, such types of protection elements involve the use of several differently shaped blanks to obtain the tubular protection elements capable of protecting the different portions of the bottle.

Furthermore, such protection elements can ruin the label, as the locking system generally consists of circular holes in which the bottle is housed. Such holes can mark the label, or the flaps of such holes can get caught on the edges of the label, ruining it.

Further, such types of protection elements oblige opening the container in which they are arranged, only on one side. For example, if placed vertically, the bottles must be extracted only from the neck, or if placed horizontally, they do not allow opening both on one side and on the other of the box.

From prior art documents DE 89 10 314 U1 and U.S. Pat. No. 2,426,899 A, further protection elements for bottles are known, obtained from blanks in papercraft material. However, such known solutions are not capable of adequately cushioning from shocks.

An object of the present invention is to overcome the drawbacks of the protection elements of the prior art in order to be modular and to be able to use the same type of modules to wrap the bottles.

Furthermore, an object of the present invention is to ensure greater protection of the objects contained and to be protected.

A still further object of the present invention is to speed up the assembly of the protection element by the user.

Lastly, an object of the present invention is to be capable of transporting the bottles in an appropriate manner, to preserve the contents thereof and to adequately cushion them from any impacts.

SUMMARY OF THE INVENTION

It is an object of the present invention to provide a protection element in papercraft material to protect one or more objects, in particular to protect one or more bottles, comprising two support elements connected by a connection element, wherein each support element has an upper wall and two support walls associated with the respective upper wall to support it, wherein a first support wall of each support element is arranged at said connection element and has a shaped opening for each object to be protected, wherein said connection element has two shaped flaps for each object to be protected, each shaped flap being arranged at the respective support element and projecting on the respective upper wall of the respective support element and on a respective shaped opening of the respective first support wall, each shaped flap being arranged so that when the respective object to be protected is arranged on said protection element resting on the respective shaped flaps, the weight of said object acts on the respective shaped flaps to insert in the respective shaped openings of said support walls and lock the object in position.

It is also an object of the present invention to provide a protection element in papercraft material to protect one or more objects, in particular to protect one or more bottles, comprising two support elements connected by a connection element, wherein each support element has an upper wall and two support walls associated below the respective upper wall to support it, wherein the upper wall of each support element is connected to said connection element, wherein a first support wall of each support element is arranged at said connection element and has a shaped opening for each object to be protected, wherein said connection element has two shaped flaps for each object to be protected, each shaped flap being arranged at the respective support element and projecting on the respective upper wall of the respective support element and on a respective shaped opening of the respective first support wall, wherein one or each shaped flap of said connection element has at least one transverse folding line, arranged transversely to said longitudinal axis, with respect to which the respective shaped flap is capable of bending, each shaped flap being configured so that when the respective object to be protected is arranged on said protection element resting on the respective shaped flaps, the weight of said object acts on the respective shaped flaps which fold with respect to the respective at least one transverse folding line to insert in the respective shaped openings of said support walls and lock the object in position.

Furthermore, according to the present invention, each shaped flap can be divided by at least one shaped folding line so that, during use, when an object is arranged on said shaped flaps they fold to conform to the respective shaped openings.

Still according to the invention, said connection element can be a flat surface divided by a folding line transverse to the longitudinal axis which joins said support elements and the protection element can be configured so that during use, when an object is positioned on the respective shaped flaps, said flat surface folds along said folding line under the weight of the object assuming a "V"-shaped longitudinal profile such that the vertex constitutes a further support element.

Again according to the invention, at least one or each upper wall of said support elements can have a protruding tooth along said longitudinal axis beyond the peripheral edge of the respective support element.

Further according to the invention, each upper wall of each support element can have a shaped opening for each object to be protected, each shaped opening being arranged at said connection element and so that when an object is arranged on said protection element resting on the respective shaped flaps, the weight of said object acts on said shaped flaps to insert in the respective shaped opening of said upper walls and support walls and lock the object in position.

Preferably according to the invention, at least one of said upper walls of said support elements can have a pair of opposite flaps projecting in the respective shaped opening and configured so that when an object is arranged on said protection element resting on the respective shaped flaps, the weight of said object acts on said shaped flaps to insert in the respective shaped opening of said upper walls and support walls being further supported by said pair of opposite flaps.

Still according to the invention, the shaped opening obtained in one or each support wall of the support elements can have a semi-polygonal shape and the respective shaped flap can have a substantially pyramidal shape with two parallel folding lines and said protection element can be configured so that during use, when an object is arranged on the respective shaped flaps they fold along the respective folding lines to conform to the corners of said shaped openings.

Again according to the invention, one or each shaped flap of said connection element can have at least one transverse folding line, arranged transversely to said longitudinal axis, adapted to allow the folding of said flap when an object is resting thereon.

Further according to the invention, each support element can have a rectangular transverse section, so as to have two support walls arranged parallel to each other and an upper wall and a lower wall parallel to each other and transverse to said support walls.

Furthermore, an object of the present invention is a blank for obtaining the described protection element, characterised in that it consists of a sheet of papercraft material divided along a longitudinal axis by a plurality of folding lines transverse to said longitudinal axis which divide it into a plurality of panels which constitute said support walls and said upper walls of said support elements, and said connection element, and in that by folding said blank along said folding lines in the same direction with respect to one face thereof, and by coupling at least two walls of said support elements to each other, said protection element is obtained in assembled configuration.

An object of the present invention is also a blank for obtaining the protection element as described, characterised in that it consists of a sheet of papercraft material divided along a longitudinal axis by a plurality of folding lines transverse to said longitudinal axis which divide it into a plurality of panels which constitute said support walls and said upper walls of said support elements, and said connection element of the protection element, in that the two panels which form the upper wall of the two support elements and the panel which forms the connection element are adjacent, in that each shaped flap is obtained in the adjacent surface between the panel which forms the connection element, from which it is separated by a respective transverse folding line, and one of the two panels which form the upper wall of a support element, in that said shaped opening is obtained in the panel which forms a support wall of the respective support element, and in that by folding said blank along said transverse folding lines in the same direction with respect to one of the faces thereof, and by coupling at least two walls of said support elements therebetween, said protection element is obtained in assembled configuration.

In particular, according to the invention, said folding lines can divide said blank into the following at least eleven panels adjacent one another that are arranged in the following order to constitute: a first support wall of a first support element, the lower wall of said first support element, the second support wall of the first support element, the upper wall of the first support element, the connection element, the upper wall of the second support element, a first support wall of the second support element, the lower wall of the second support element, and the second support wall of the second support element.

Still according to the invention, said blank can have a further end panel at each panel which constitutes a first support wall of a first support element and the second support wall of the second support element, divided therefrom by a further folding line transverse to the longitudinal axis and said blank can be configured so that by further folding the blank along said further folding lines, and by bringing said further panels closer to the upper walls so that they are coplanar and by coupling them together, said protection element is obtained in assembled configuration.

Again according to the invention, said further panels can have a respective protruding tooth along said longitudinal axis and the panels which form said second support walls of said support elements can have a slot such as to allow the insertion of said protruding tooth when said protection element is in assembled configuration.

Further, the present invention relates to a protection element obtained from the described blank.

Finally, the present invention relates to a box-like container comprising at least two protection elements as described, characterised in that said protection elements are arranged one above the other with the upper walls of the support elements adjacent to each other and substantially coplanar.

BRIEF DESCRIPTION OF THE SEVERAL VIEWS OF THE DRAWINGS

The invention will now be described, by way of non-limiting illustration, with particular reference to the drawings of the appended figures, in which.

DESCRIPTION OF SPECIFIC EMBODIMENTS OF THE INVENTION

Figure 1:
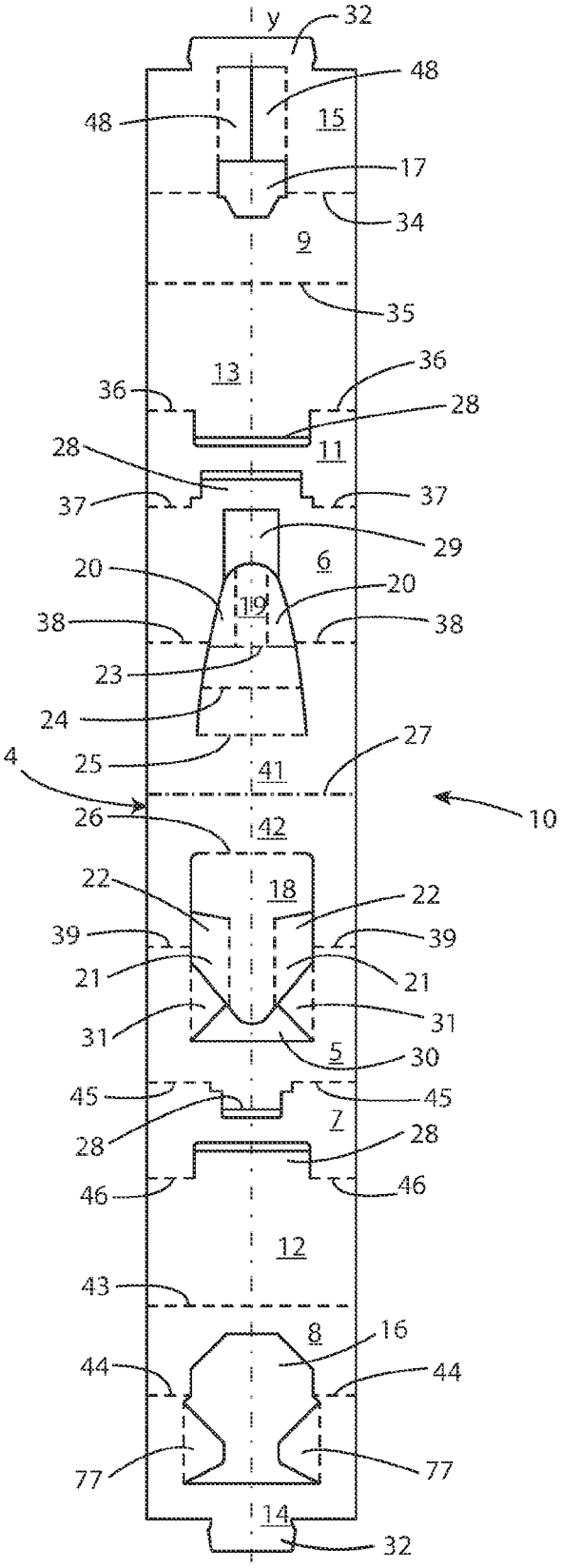
FIG. 1 shows a top view of a first blank for obtaining the protection element according to the invention, in a first embodiment.

Referring to FIG. 1, a first blank 10 is observed for making a protection element 1 according to the present invention, in the first embodiment shown in FIGS. 3-9.

Said protection element 1 is adapted to house and protect, in particular, glass bottles B. However, it can also be used to protect other types of objects, especially in fragile material.

Figure 7:
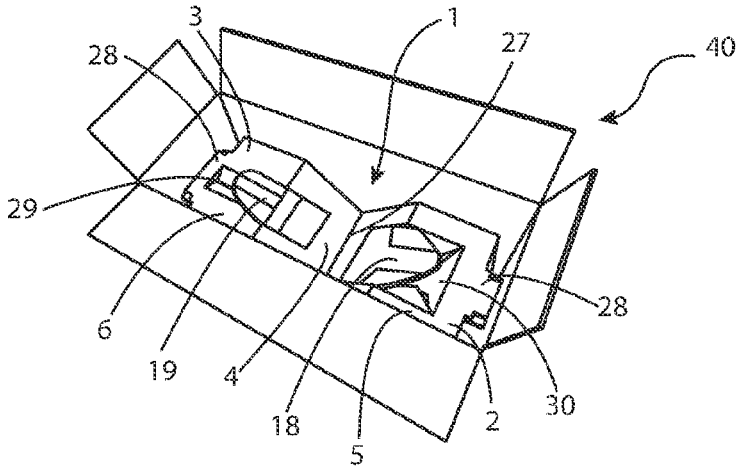
FIGS. 7, 8 and 9 show perspective views of a first and a second protection element according to FIG. 6, during the insertion in a box for the containment and protection of a bottle.
Figure 8:
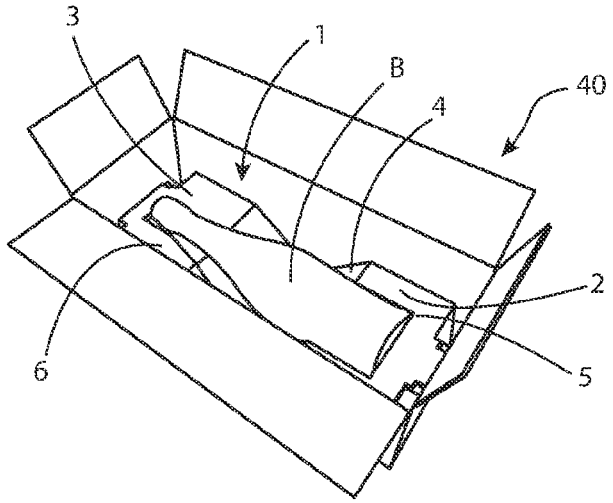
Figure 9:
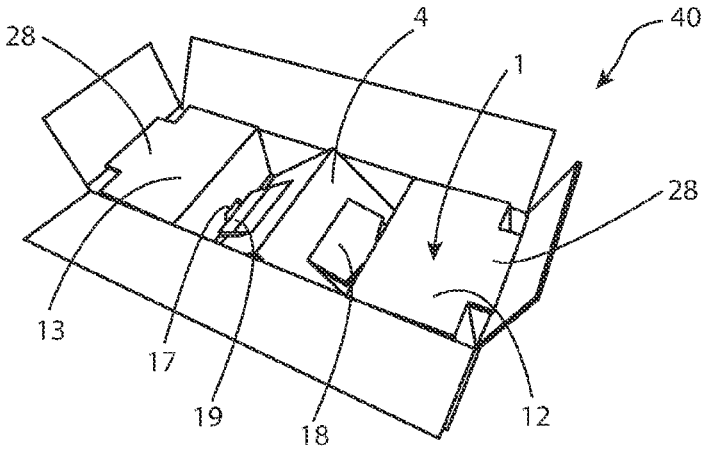

Furthermore, said protection element 1 is adapted to be inserted in a container or box 40 (as shown in FIGS. 7-9) for the protection and transport of the bottle or object to be protected. In particular, it is used in combination with another protection element 1, substantially the same or specular, as will be explained in the following.

The protection element 1 according to the present invention is obtained in papercraft material, papercraft material meaning any material sold in sheets, of mechanical features equivalent to cardboard or poster board, and which can be processed by machinery of the papercraft industry. In particular, sheets of papercraft material can be cut, for example die-cut, and folded along folding lines through the use of creases or broken cutting lines.

An EB-type corrugated cardboard, preferably 5 mm thick, was used in the specific embodiment.

Preferably, the protection element 1 according to the invention is obtained from the blank 10 of FIG. 1, but can also be obtained from one or more blanks of different shape.

Figure 5:
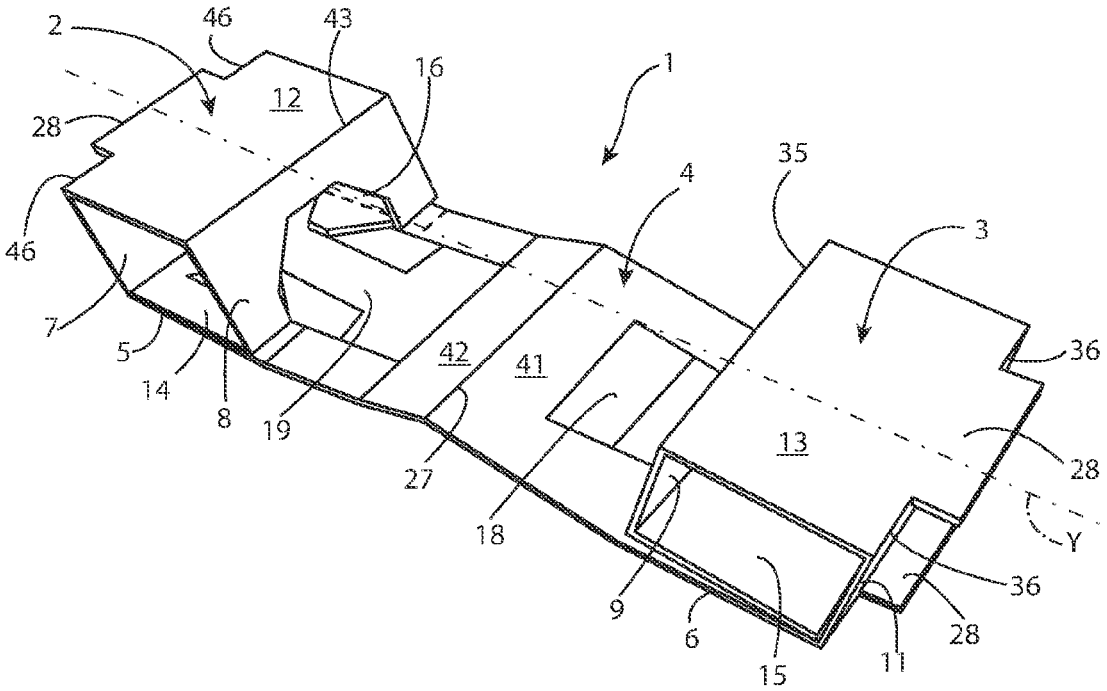
Figure 6:
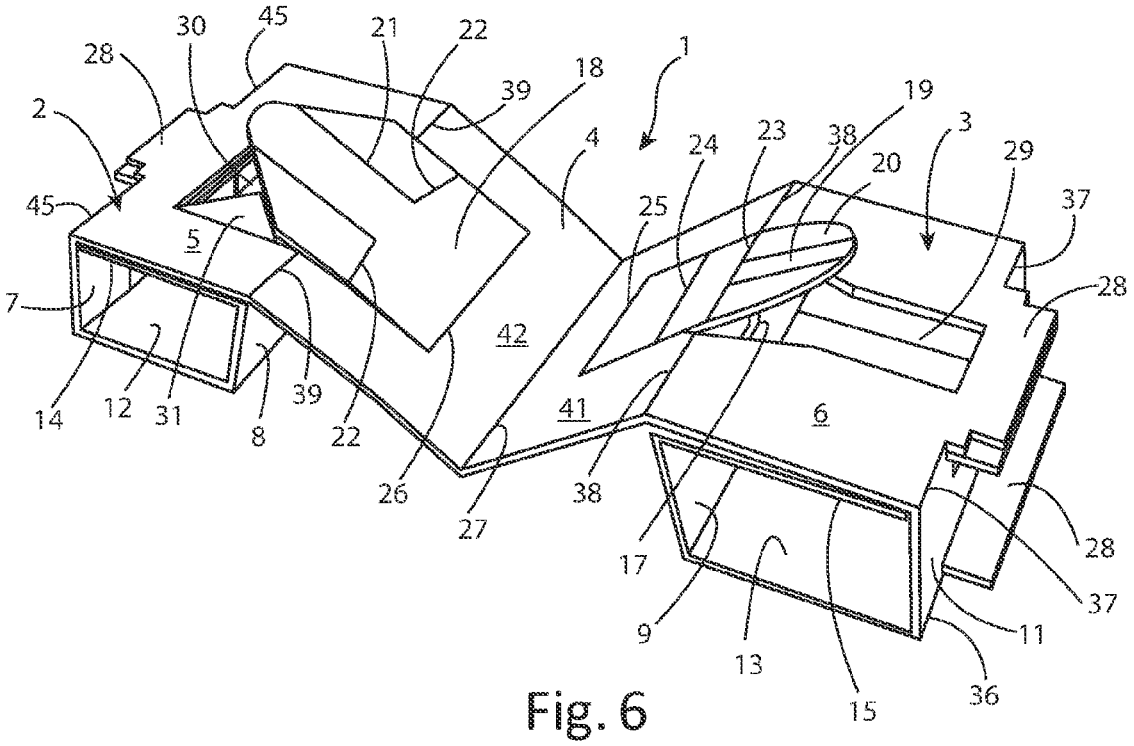

With particular reference to FIGS. 5 and 6, which show the protection element 1 according to the invention respectively from the bottom and from the top, it is observed that the protection element 1 comprises two support elements 2 and 3 connected, along a longitudinal axis y, by a connection element 4. Each support element 2 or 3 has an upper wall 5 or 6 and at least two support walls 7, 8 or 9, 11, associated with the respective upper wall 5 or 6 to support it. In particular, the two support walls 7, 8 or 9, 11 are arranged below the respective upper wall 5 or 6.

In particular, each support element 2 or 3 can have, as in the embodiment shown, a rectangular transverse section, so as to have two support walls 7, 8 or 9, 11 arranged parallel to each other and an upper wall 5 or 6 and a lower wall 12 or 13 parallel to each other and transverse to said support walls 7, 8 or 9, 11.

As can be seen in FIG. 6, the upper wall 5 or 6 of each support element 2, 3 is connected to said connection element 4. In particular, they are adjacent panels, in particular contiguous panels of the same sheet of papercraft material, divided by a respective transverse folding line 39, 38, transverse to the longitudinal axis y. In other words, the connection element 4 is arranged and connected to the two upper walls 5 and 6 of the two support elements 2 and 3.

Furthermore, a first support wall 8 or 9 of each support element 2, 3 is arranged at said connection element 4 and has a shaped opening 16 or 17.

In turn, the connection element 4 has a shaped flap 18 or 19 at each support element 2 or 3 projecting on the respective upper wall 5 or 6 and on the shaped opening 16 or 17 of the respective first support wall 8 or 9.

Each shaped flap 18 and 19 is arranged so that when an object, in particular a bottle B (as shown in FIG. 8), is arranged on said protection element 1 resting on said shaped flaps 18 and 19, the weight of said object B acts on said shaped flaps 18 and 19 to insert in the respective shaped opening 16 and 17 of said support walls 8 and 9 and lock the object B in position.

Preferably as shown in FIG. 7, a first protection element 1 is preliminarily arranged inside a box 40, having a compartment of equivalent perimeter dimensions, with the upper walls 5 and 6 arranged upwards and the support walls 7, 8 and 9, 11 resting on the bottom of the box 40. Subsequently (as shown in FIG. 8) the bottle B is placed on the protection element 1, so as to lie on the respective shaped flaps 18 and 19, and thus being protected in a first portion.

Lastly (as shown in FIG. 9) a second protection element 1 is arranged inside the compartment of the box 40 overlapping the first protection element 1 and the bottle B with the upper walls 5 and 6 of the support elements 2 and 3 of the second protection element 1 arranged above the upper walls 5 and 6 of the support elements 2 and 3 of the first protection element 1, so that the shaped flaps 18 and 19 of the second protection element 1 also abut the body of the bottle B, being arranged inside the respective shaped openings 16 and 17 of the support elements 2 and 3 of the second protection element 1 which therefore wraps a second portion of the bottle B, further protecting it inside the box 40, which can then be closed for transport.

In the protection element 1 according to the embodiment shown in FIGS. 5 and 6, each shaped flap 18 or 19 can be divided by at least one folding line 20 or 21 shaped so that, during use, when an object B is arranged on said shaped flaps 18 and 19 they fold to conform to said shaped openings 16 and 17.

Further, as in the embodiment shown, the shaped opening 16 or 17 obtained in one or each of the first support wall 8 or 9 of the support elements 2 and 3 can have a semi-polygonal shape.

In the specific embodiment, the shaped opening 17 obtained in the first support wall 9 of the first support element 3 has a semi-hexagonal shape (i.e., half hexagon), while the shaped opening 16 obtained in the first support wall 8 of the second support element 2 has a semi-octagonal shape (i.e., half octagon).

Furthermore, the respective shaped flap 18 or 19 can have a substantially pyramidal shape with two parallel folding lines 20 or 21 and the protection element 1 can thus be configured so that during use, when an object B is arranged on said shaped flaps 18 and 19, they fold along the respective folding lines 20 and 21 to conform to the corners of said shaped openings 16 and 17.

This also allows to conform to and better wrap the object to be housed, in particular the bottle B.

Furthermore, as shown in FIG. 6, one or each shaped flap 18 or 19 of said connection element 4 can have at least one transverse folding line 24, 25 or 26, arranged transversely to said longitudinal axis y and adapted to allow the folding of said shaped flap 18 or 19 when an object B is resting thereon. In other words, each shaped flap 18 or 19 is capable of pivoting with respect to the respective transverse folding line 26 or 25 to rotate with respect to the surface of the connection element 4 under the load of the object B resting thereon.

In particular, as shown in the appended drawings, the connection element 4 is preferably a flat surface, made of papercraft material, on which said shaped flaps 18 and 19 are obtained connected to said flat surface by means of said transverse folding lines 26 and 25.

More specifically, said connection element 4 is a flat surface divided by a folding line 27 transverse to the longitudinal axis y which joins said support elements 2, 3, dividing said connection element 4 into two portions 41 and 42 joined at said transverse folding line 27 and connected from the opposite side to the respective support element 2 or 3 by a pair of connecting edges 39 or 38.

Therefore, said protection element 1 is configured so that during use, when an object B is positioned on said shaped flaps 18 and 19, said flat surface of the connection element 4 folds along said folding line 27 under the weight of the object B assuming a "V"-shaped longitudinal profile such that the vertex constitutes a further support element, resting on the support surface (as shown in FIG. 6).

Also as in the embodiment shown in FIGS. 5 and 6, at least each upper wall 5, 6 of said support elements 2, 3 can have a protruding tooth 28 along said longitudinal axis y beyond the peripheral edge of the respective support element 2, 3. Such protruding teeth 28 can also be present at the lower walls 12 and 13, again as shown in the embodiment of FIGS. 5 and 6.

As shown in FIGS. 7-9, the protruding teeth 28 have the purpose of spacing the protection element 1 from the edges of the box 40 in which it is inserted and cushioning any impacts along the longitudinal axis y which the box 40 can undergo.

Furthermore, as shown in the embodiment of FIGS. 5 and 6, each upper wall 5, 6 of each support element 2, 3 can have a shaped opening 29; 30 at said connection element 4 arranged so that when an object B is arranged on said protection element 1 resting on said shaped flaps 18; 19, the weight of said object B acts on said shaped flaps 18; 19 to insert in the respective shaped opening 30, 16; 29, 17 of said upper walls 5; 6 and support walls 8; 9 and lock the object B in position.

Such upper shaped openings 29 and 30 can be shaped with the form of the object to be housed. In the embodiment shown, they are shaped according to the upper and lower shape of a bottle B.

Furthermore, at least one of said upper walls 5 of said support elements 2, specifically the upper wall 5 of the second support element 2, can have a pair of opposite flaps 31 projecting in said upper shaped opening 30 and configured so that when an object B is arranged on said protection element 1 resting on said shaped flaps 18; 19 of the connection element 4, the weight of said object B acts on said shaped flaps 18; 19 to insert in the respective shaped opening 30, 16; 29, 17 of said upper walls 5; 6 and support walls 8; 9 being further supported by said pair of flaps 31, on which the shaped flaps 18 and 19 of the connection element 4 rest in abutment.

As mentioned above, the protection element 1 according to the present invention and according to the particular embodiment described can be obtained from the blank 10 of FIG. 1.

Said blank 10 consists of a single sheet of papercraft material divided along a longitudinal axis y by a plurality of folding lines 35, 36, 37, 38, 39, 45, 46, and 43 transverse to said longitudinal axis y, and therefore parallel to each other, which divide it into a plurality of panels which constitute said support walls 7, 8, 9, 11 and said upper walls 5 and 6 of said support elements 2 and 3, and said connection element 4. Therefore, by folding said blank 10 along said folding lines in the same direction with respect to one of the faces thereof, in particular downstream with respect to the face visible from the top of FIG. 1 and by coupling at least two walls of said support elements 2 and 3 together, said protection element 1 is obtained.

In the figures, the folding lines downstream of the face shown in FIG. 1 are shown with dashed lines, while the folding lines upstream of said face are shown with dashed and dotted lines.

In particular, the two panels 5, 6 which form the upper wall of the two support elements 2, 3 and the panel 4 which forms the connection element 4 are adjacent. Furthermore, each shaped flap 18; 19 is formed in the adjacent surface between the panel 4 which forms the connection element 4, from which it is separated by a respective transverse folding line 25, 26, and one of the two panels 5, 6 which forms the upper wall of a support element 2, 3.

Said shaped opening 16, 17 is obtained in the panel which forms a support wall 8; 9 of the respective support element 2, 3.

Figure 3:
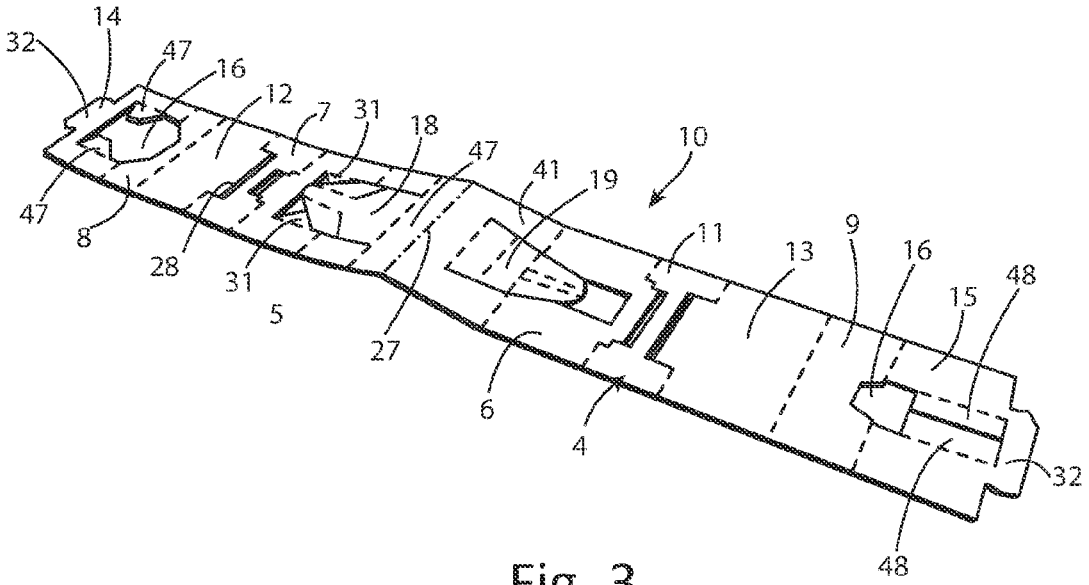
FIGS. 3, 4, 5 and 6 show perspective views of the protection element according to the invention obtained with the blank of FIG. 1 during the different assembly steps.
Figure 4:
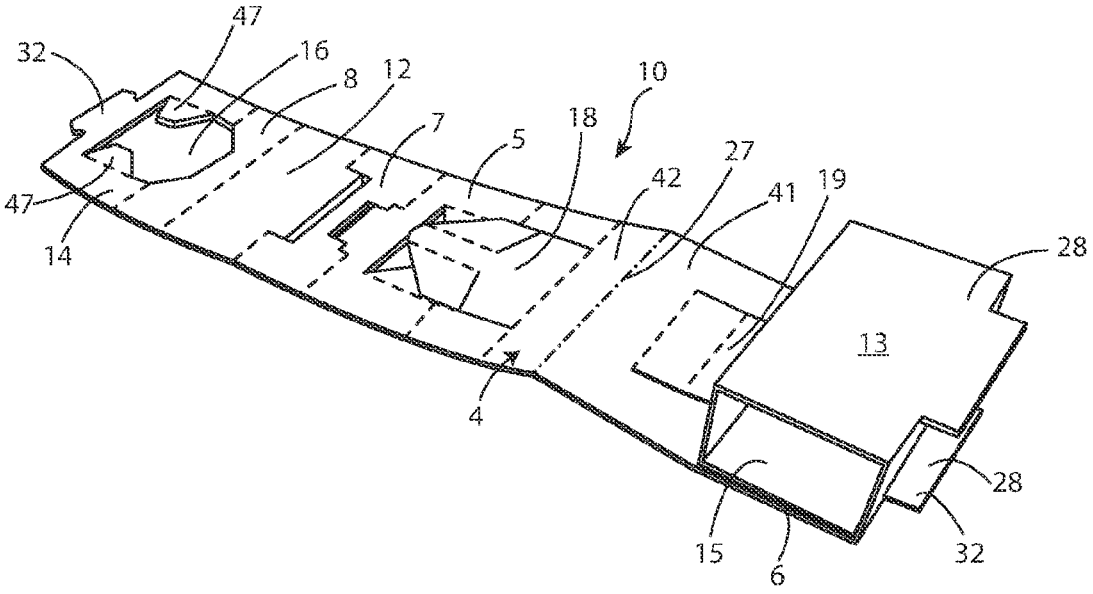

Some steps of folding the blank 10 of FIG. 1 are shown in FIGS. 3 and 4 which lead to obtaining the protection element 1 of FIGS. 5 and 6.

More in particular, in the blank 10 according to the particular embodiment of FIG. 1 said folding lines 35, 36, 37, 38, 39, 45, 46 and 43 can divide said blank 10 into the following at least eleven adjacent panels arranged in the following order to constitute: a first support wall 9 of a first support element 3, the lower wall 13 of said first support element 3, the second support wall 11 of the first support element 3, the upper wall 6 of the first support element 3, the connection element 4, the upper wall 5 of the second support element 2, a first support wall 7 of the second support element 2, the lower wall 12 of the second support element 2, and the second support wall 8 of the second support element 2.

In order to obtain the "V"-shaped longitudinal profile as described above, and visible for example in FIG. 6, said blank 10 has a further folding line 27 parallel to the other folding lines which divide the blank 10 into several panels, in particular transverse to the longitudinal axis y, said folding line 27 being adapted to be folded upstream of the face visible from above in FIG. 1, in any case in the opposite direction to the folding direction of the other folding lines.

Preferably, the blank 10 can have a further end panel 14, 15 at each panel which constitutes a first support wall 9 of a first support element 3 and the second support wall 8 of the second support element 2, divided therefrom by a further folding line 34, 44 transverse to the longitudinal axis y and in that it is configured so that by further folding the blank 10 along said further folding lines 34 and 44, and by bringing said further panels 14 and 15 closer to the adjacent corresponding upper wall 5, 6 so that they are coplanar and coupling them together, said protection element is obtained.

In the particular embodiment, said further panels 14, 15 preferably have a respective protruding tooth 32 along said longitudinal axis y and the panels which form said second support walls 7, 11 of said support elements 2, 3 have a slot 33 such as to allow the insertion of said protruding tooth 32 when said protection element 1 is in assembled configuration.

Preferably, said end panels 14, 15 or directly said panels which form said first support walls 8, 9 can be firmly coupled, for example by gluing, to the adjacent panels.

Still as shown in the embodiment of FIG. 1, said end panels 14, 15 can have a pair of panels 48 or 47 which is opposite with respect to said longitudinal axis y and configured so that when said blank 10 is assembled in said protection element 1, they are at the respective shaped opening 30 or 29 of the respective support element 2 or 3 to further support said object B when arranged on said protection element 1.

More in particular, at least one pair of opposite flaps 47 of a first panel 14 can be located at the first pair of opposite flaps 31 arranged in the upper wall 5 of the second support element 2, to further support a portion of the object B to be protected, possibly the heavier portion, as in the case of the lower portion of a bottle B which turns out to be heavier than the upper portion thereof.

As shown in FIGS. 2 and 10-13, the protection element 1 can be adapted to house several objects, in particular bottles B, arranged parallel to said longitudinal axis y. In the particular embodiment shown in FIGS. 2 and 10-13, it is capable of housing three bottles B.

The second embodiment of such a protection element 1 has the same elements as the embodiment of FIGS. 5 and 6, in fact it has two support elements 2 and 3 joined along the longitudinal axis y by a connection element 4, however it has three pairs of shaped flaps 18 and 19 for each object B to be housed and three respective shaped openings 16 and 17 obtained on each first support wall 7 and 9 of each support element 2, 3.

Furthermore, it can also include three respective upper shaped openings 29, 30 on each upper wall 5, 6 of each support element 2, 3.

Naturally in further embodiments, said protection element 1 can include more or less housings based on the objects to be housed and protected.

Figure 10:
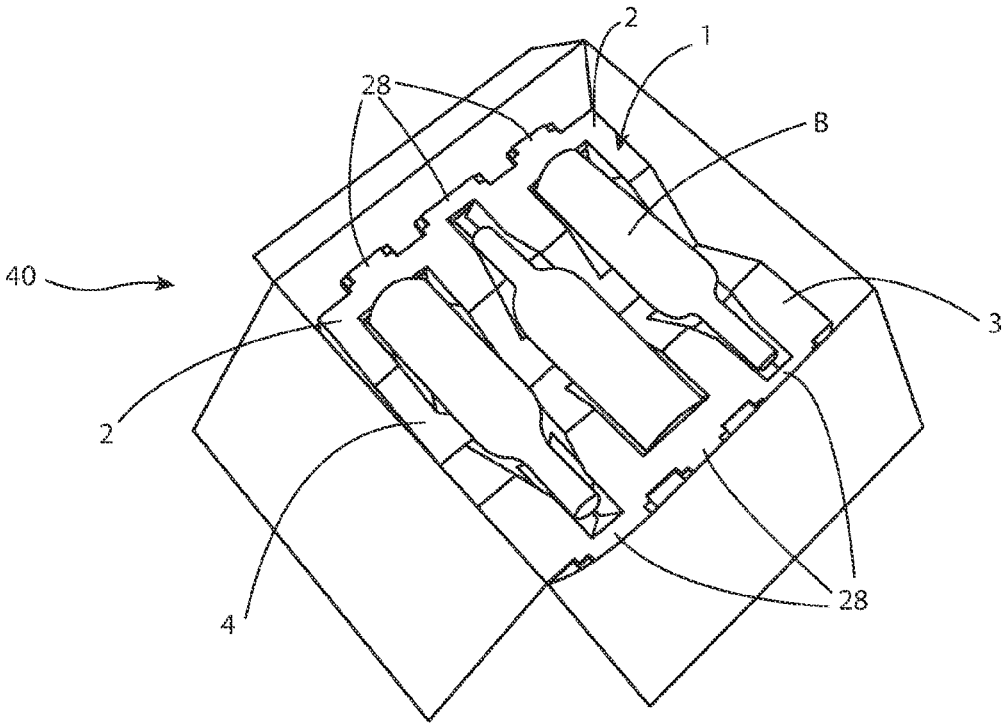
FIGS. 10 and 11 show perspective views of a first and a second protection element obtained by the blank of FIG. 2, during the insertion in a box for the containment and protection of three bottles.
Figure 11:
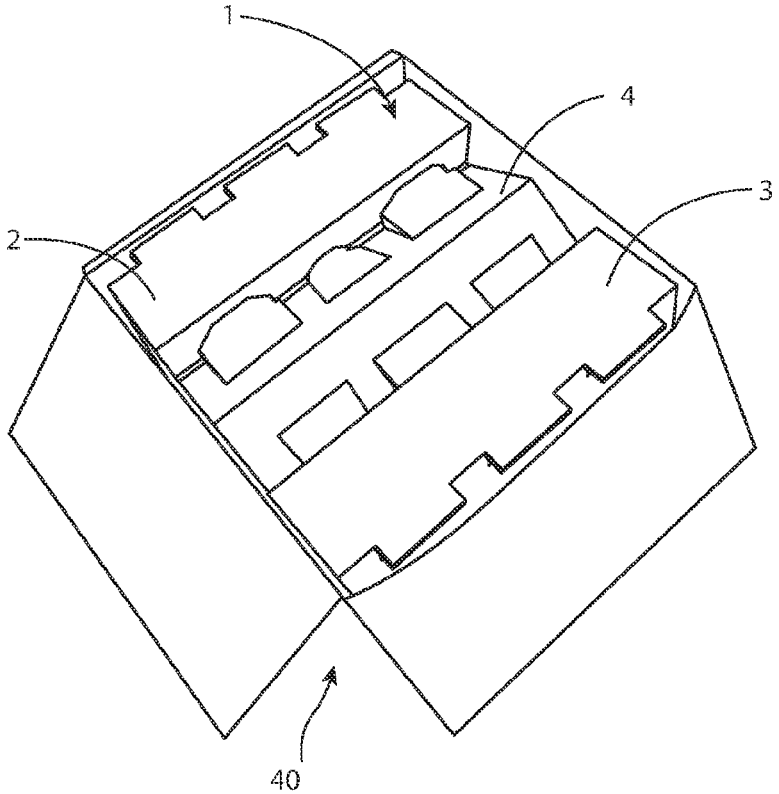
Figure 12:
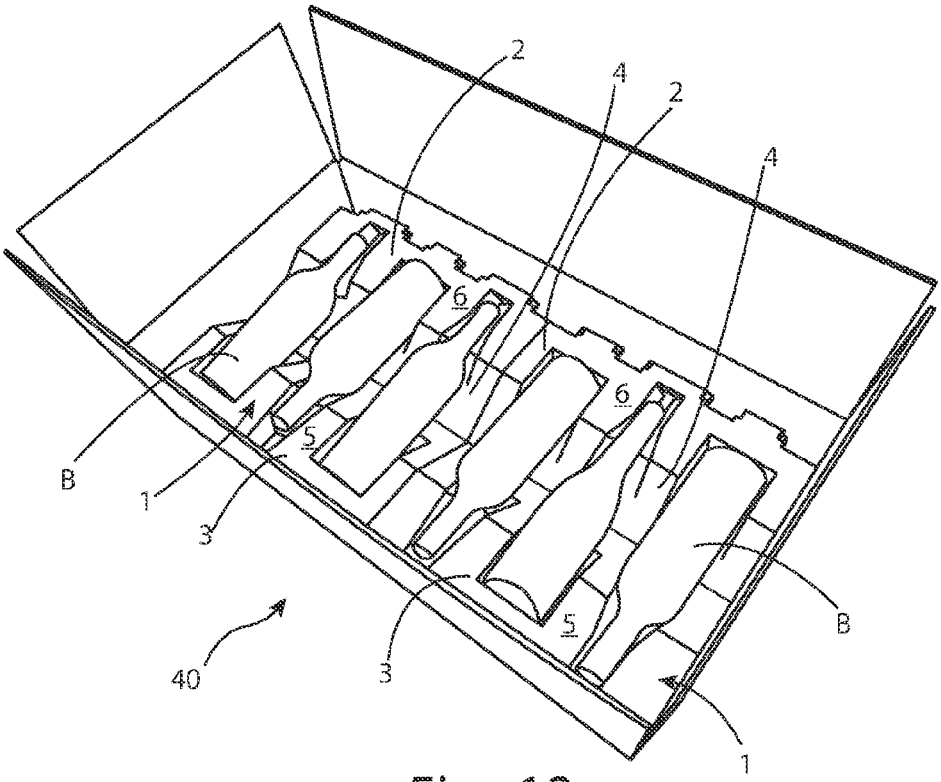
FIGS. 12 and 13 show perspective views of four protection elements obtained by the blank of FIG. 2, during the insertion in a box for the containment and protection of six bottles.
Figure 13:
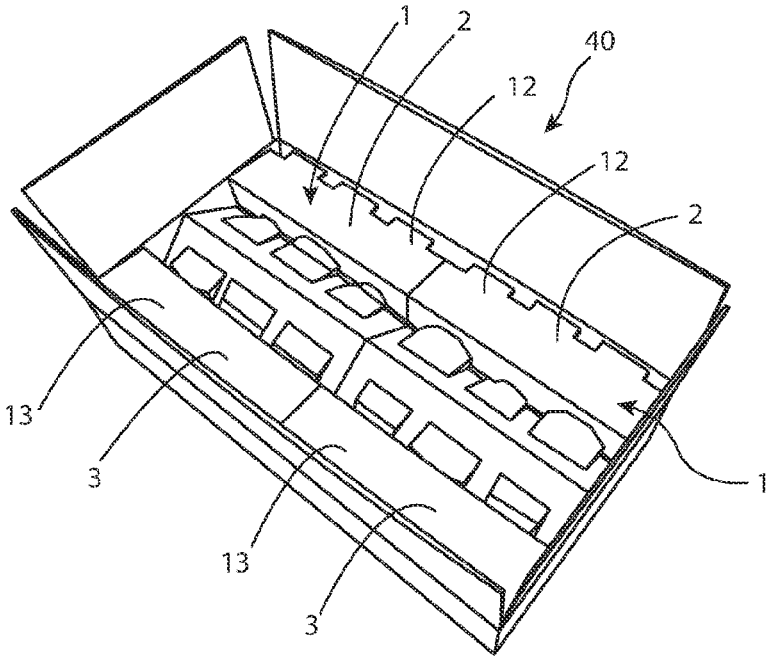

As shown in FIGS. 10 and 11, each protection element 1 can be arranged in a respective container 40 to house three bottles and then be overlapped with a second protection element 1 as explained for the embodiment of FIGS. 5 and 6. Furthermore, as shown in FIGS. 12 and 13, multiple protection elements 1 can be inserted in a single container 40 arranged side by side transversely to said longitudinal axis y, in FIGS. 12 and 13 there are two pairs of protection elements 1 for housing and transporting 6 bottles.

Preferably, when it is necessary to house multiple bottles, the shaping is obtained so as to house adjacent bottles arranged oppositely (cap-base) to the adjacent bottle (base-cap), to gain material in a transverse direction and reduce the risk of contact between the bottles.

Figure 2:
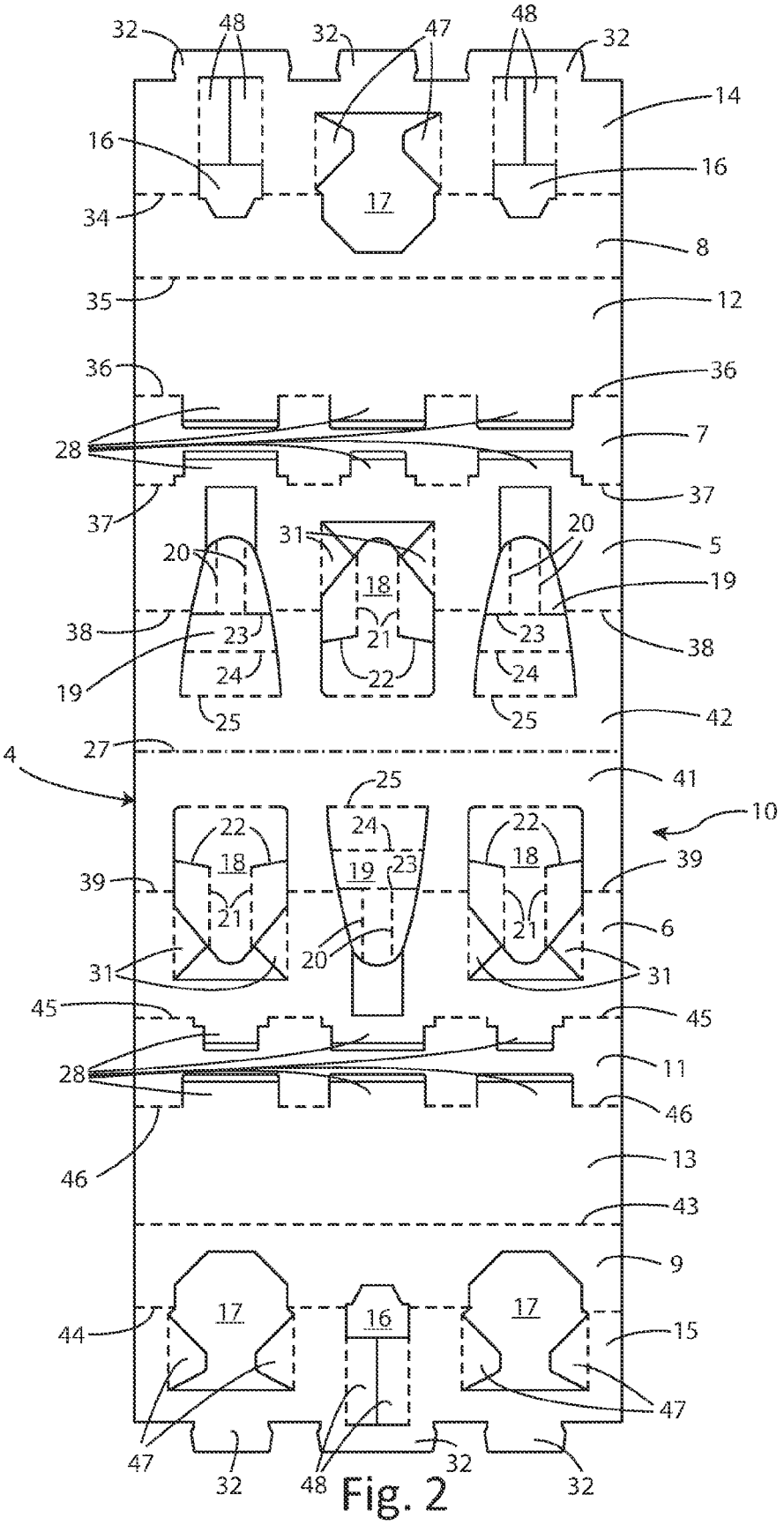
FIG. 2 shows a top view of a second blank for obtaining the protection element according to the invention, in a second embodiment.

Also such a second embodiment of the protection element 1 according to the invention can be obtained from a single blank 10 such as that shown in FIG. 2, which is obtained and assembled in the same manner as the blank 10 of FIG. 1, with the difference that it has said shapes for the flaps and the openings for housing said objects, arranged in a transverse direction with respect to said longitudinal axis y.

Advantageously, the protection element according to the invention, when inserted in pairs in a box, allows opening both of the openable sides of the box.

Furthermore, the present invention advantageously ensures excellent protection of the housed object, thanks to the flaps which act as reinforcements, in particular, for example, on the neck and bottom of the bottle.

Still advantageously, the blank according to the invention can be glued to assemble it more quickly, eliminating or reducing manual joints.

Finally, when the protection elements are placed in a box, despite the fact that during transport, for example by courier, it can be inverted several times, thanks to the horizontal arrangement of the bottles, it allows a better storage of the wine contained. This allows to fill the bottle long before the actual transport, and does not force the recipient to immediately remove the bottles from the box, once received.

The preferred embodiments have been described above and variants on the present invention have been suggested, but it must be understood that those skilled in the art can make modifications and changes without thereby falling outside the relative scope of protection, as defined by the appended claims.

The invention claimed is:

1. A protection element (1) made of papercraft material to protect one or more objects (B), comprising two support elements (2, 3) connected by a connection element (4), wherein each support element (2, 3) has an upper wall (5; 6) and two support walls (7, 8; 9, 11) associated below the respective upper wall (5; 6) to support it, wherein the upper wall (5; 6) of each support element (2; 3) is connected to said connection element (4), wherein a first support wall (8; 9) of each support element (2, 3) is arranged at said connection element (4) and has a shaped opening (16; 17) for each object (B) to be protected, wherein said connection element (4) has two shaped flaps (18; 19) for each object (B) to be protected, each shaped flap (18; 19) being arranged at the respective support element (2; 3) and projecting on the respective upper wall (5, 6) of the respective support element (2; 3) and on a respective shaped opening (16; 17) of the respective first support wall (8; 9), wherein one or each shaped flap (18, 19) of said connection element (4) has at least one transverse folding line (24, 25, 26), arranged transversely to a longitudinal axis (y), with respect to which the respective shaped flap (18, 19) is capable of folding, each shaped flap (18; 19) being configured so that when the respective object (B) to be protected is arranged on said protection element (1) resting on the respective shaped flaps (18; 19), the weight of said object (B) acts on the respective shaped flaps (18; 19) which fold with respect to the respective at least one transverse folding line (24, 25, 26) to insert in the respective shaped openings (16; 17) of said support walls (8; 9) and lock the object (B) in position.

2. The protection element (1) according to claim 1, wherein said connection element (4) is a flat surface divided by a folding line (27) transverse to the longitudinal axis (y) which joins said support elements (2, 3) and in that it is configured so that, during use, when an object (B) is positioned on the respective shaped flaps (18; 19) said flat surface folds along said folding line (27) under the weight of the object (B) assuming a "V"-shaped longitudinal profile such that the vertex constitutes a further support element.

3. The protection element (1) according to claim 1, wherein at least one or each upper wall (5, 6) of said support elements (2, 3) has a protruding tooth (28) along said longitudinal axis (y) beyond the peripheral edge of the respective support element (2, 3).

4. The protection element (1) according to claim 1, wherein each upper wall (5, 6) of each support element (2, 3) has a shaped opening (29; 30) for each object (B) to be protected, each shaped opening (29; 30) being arranged at said connection element (4) and so that when an object (B) is arranged on said protection element (1) resting on the respective shaped flaps (18; 19), the weight of said object (B) acts on said shaped flaps (18; 19) to insert in the respective shaped opening (30, 16; 29, 17) of said upper walls (5; 6) and support walls (8; 9) and lock the object (B) in position.

5. The protection element (1) according to claim 4, wherein at least one of an upper wall (5) of a support element (2) has a pair of opposite flaps (31) projecting in the respective shaped opening (30) and configured so that when an object (B) is arranged on said protection element (1) resting on the respective shaped flaps (18; 19), the weight of said object (B) acts on said shaped flaps (18; 19) to insert in the respective shaped opening (30, 16; 29, 17) of said upper walls (5; 6) and support walls (8; 9) being further supported by said pair of opposite flaps (31).

6. The protection element (1) according to claim 1, wherein the shaped opening (16, 17) obtained in one or each support wall (8, 9) of the support elements (2, 3) has a semi-polygonal shape and in that the respective shaped flap (18, 19) has a substantially pyramidal shape with two parallel folding lines (20, 21) and in that it is configured so that during use, when an object (B) is arranged on the respective shaped flaps (18; 19) they fold along the respective folding lines to conform to the corners of said shaped openings (16; 17).

7. The protection element (1) according to claim 1, wherein each support element (2, 3) has a rectangular transverse section, so as to have two support walls (7, 8; 9, 11) arranged parallel to each other and an upper wall (5; 6) and a lower wall (12, 13) parallel to each other and transverse to said support walls (7, 8; 9, 11).

8. A blank (10) for obtaining the protection element (1) according to claim 7, wherein it consists of a sheet of papercraft material divided along the longitudinal axis (y) by a plurality of folding lines (35, 36, 37, 38, 39, 45, 46, 43) into a plurality of panels which constitute said support walls (7, 8, 9, 11) and said upper walls (5, 6) of said support elements (2, 3), and said connection element (4) of the protection element (1), in that the two panels (5, 6) which form the upper wall of the two support elements (2, 3) and the panel (4) which forms the connection element (4) are adjacent, in that each shaped flap (18; 19) is obtained in the adjacent surface between the panel (4) which forms the connection element (4), from which it is separated by a respective transverse folding line (25, 26), and one of the two panels (5, 6) which forms the upper wall (2, 3)

in that in the panel which forms a support wall (8; 9) of the respective support element (2, 3) said shaped opening (16, 17) is obtained, and in that by folding said blank (10) along said transverse folding lines (35, 36, 37, 38, 39, 45, 46, 43) in the same direction with respect to one of the faces thereof, and by coupling at least two walls of said support elements (2, 3) together, said protection element (1) is obtained in assembled configuration.

9. The blank (10) according to claim 8, wherein said folding lines (35, 36, 37, 38, 39, 45, 46, 43) divide said blank into the following at least eleven panels adjacent to each other arranged in the following order to constitute: a first support wall (9) of a first support element (3), the lower wall (13) of said first support element (3), the second support wall (11) of the first support element (3), the upper wall (6) of the first support element (3), the connection element (4), the upper wall (5) of the second support element (2), a first support wall (7) of the second support element (2), the lower wall (12) of the second support element (2), and the second support wall (8) of the second support element (2).

10. The blank (10) according to claim 9, further comprising a further end panel (14, 15) at each panel which constitutes a first support wall (9) and the second support wall (8) of the second support element (2), divided therefrom by a further folding line (34, 44) transverse to the longitudinal axis (y) and in that it is configured so that by further folding the blank (10) along said further folding lines (34, 44), and by bringing said further panels (14, 15) closer to the upper walls (5, 6) so that they are coplanar and coupling them together, said protection element (1) is obtained in assembled configuration.

11. The blank (10) according to claim 10, wherein said further panels (14, 15) have a respective protruding tooth (32) along said longitudinal axis (y) and in that the panels which form said second support walls (7, 11) of said support elements (2, 3) have a slot (33) such as to allow the insertion of said protruding tooth (32) when said protection element (1) is in assembled configuration.

12. A box container (40) comprising at least two protection elements (1) according to claim 1, wherein said protection elements (1) are arranged one above the other with the upper walls (5, 6) of the support elements (2, 3) adjacent to each other and substantially coplanar.

13. The protection element (1) obtained from the blank according to claim 8.

14. A box container (40) comprising at least two protection elements (1) according to claim 13, wherein said protection elements (1) are arranged one above the other with the upper walls (5, 6) of the support elements (2, 3) adjacent to each other and substantially coplanar.

* * * * *